US005970513A

United States Patent [19]

Kocher

[11] Patent Number: 5,970,513

[45] Date of Patent: Oct. 26, 1999

[54] MULTI-PIECE INTEGRATED BODY ARMOR SYSTEM (MIBAS)

[76] Inventor: Robert William Kocher, 4828 3rd St. North, Arlington, Va. 22203

[21] Appl. No.: 09/163,763

[22] Filed: Sep. 30, 1998

Related U.S. Application Data

[60] Provisional application No. 60/070,232, Dec. 31, 1997.

[51] Int. Cl.[6] ..... A41M 1/02

[52] U.S. Cl. ..... 2/2.5; 2/103; 2/455; 2/463

[58] Field of Search ..... 2/2.5, 455, 456, 2/462, 463, 464, 467, 102, 103, 115

[56] References Cited

U.S. PATENT DOCUMENTS

| | | | |
|---|---|---|---|
| 3,582,988 | 6/1971 | Armellino | 2/2.5 |
| 4,466,135 | 8/1984 | Coppage | 2/2.5 |
| 4,485,491 | 12/1984 | Rasmussen | 2/2.5 |
| 4,535,478 | 8/1985 | Zufle | 2/2.5 |
| 4,697,285 | 10/1987 | Sylvester | 2/2.5 |
| 5,495,621 | 3/1996 | Kibbee | 2/2.5 |
| 5,621,914 | 4/1997 | Ramone et al. | 2/463 |
| 5,754,982 | 5/1998 | Gainer | 2/2.5 |

FOREIGN PATENT DOCUMENTS 2210773 6/1989 United Kingdom .

*Primary Examiner*—John J. Calvert
*Assistant Examiner*—Tejash Patel

[57] ABSTRACT

The Multi-Piece, Integrated Body Armor System is a two component system. The first component consists of a small piece of body armor, worn as an undergarment, that can weigh less than 2 pounds (a hard ballistic plate is optional) and covers the human upper torso area (lower neck to below the heart). The second component consists of a vest/jacket that is worn over a normal shirt. This component provides ballistic protection for areas where the first component's protection ends. The significance of this invention is that it offers complete, inconspicuous, ballistic protection while providing the wearer ease and comfort of continuous wear of the undergarment component and ease of removal for the externally worn component.

15 Claims, 2 Drawing Sheets

MULTI-PIECE INTEGRATED BODY ARMOR SYSTEM (MIBAS)

This Appln claims the benefit of U.S. Provisional Appln Ser. No. 60/070,232, filed Dec. 31, 1997.

CROSS REFERENCE TO RELATED APPLICATIONS

Not Applicable

STATEMENT REGUARDING FEDERALLY SPONSORED RESEARCH OR DEVELOPMENT

Not Applicable

REFERENCE TO A MICROFICHE APPENDIX

Not Applicable

BACKGROUND OF INVENTION

Two major types of conventional body armor are Overclothing Body Armor or externally worn body armor, hereinafter referred to as OBA, and Undergarment Body Armor normally worn under a shirt, hereinafter referred to as UBA. OBA is generally bulky, heavy, and sometimes very conspicuous when worn. The military and law enforcement versions of OBA include flack jackets or body armor. For civilian clothing use, versions of OBA have been made to look like cold weather coats or jackets to provide less conspicuous protection when required. However, cold weather coats worn during warm weather are not inconspicuous. The business suit jacket is a more versatile, less conspicuous configuration of OBA, but this configuration lacks frontal protection from the base of the neck to below the heart—the torso's most vital area. On the other hand, a significant advantage of OBA is the ease with which the wearer can put it on and take it off when required.

Conventional UBA is an alternative to conventional OBA yet it has distinct advantages and disadvantages. UBA is inconspicuous and provides good protection to the body's vital frontal area. However, UBA typically weighs 4 to 10 pounds, creates body heat build up, and restricts the movement of the user due to the UBA material's inflexibility. Another major disadvantage of UBA is its difficulty to put on and take off since it is worn under other clothing. Because of this, the user is normally forced to wear UBA at times when it is not necessary.

The numerous disadvantages of conventional OBA and UBA result in the reluctance of an individual to wear the equipment unless the user feels substantially threatened. This results in the user taking risks of not wearing body armor when it is warranted.

The Multi-Piece, Integrated Body Armor System, hereinafter referred to as MIBAS, combines advantages of conventional OBA and UBA to create a system that is more versatile, provides protection over a larger area of the body, and will enhance the user's desires to wear body armor.

Closest Known Prior Art: There are numerous designs for conventional UBA and OBA. However, the MIBAS is the first body armor system that attempts to combine the advantages of UBA and OBA that will advance a new generation of body armor systems.

BRIEF SUMMARY OF THE INVENTION

The significance of this invention is that it offers complete, inconspicuous, ballistic protection while providing the wearer ease of removal. Protective business suit jackets typically do not provide ballistic protection for the upper torso. The MIBAS addresses this shortcoming.

The MIBAS is a two component system. The first component consists of a small piece of body armor, worn as an undergarment, that can weigh less than 2 pounds (a hard ballistic plate is optional) and covers the human upper torso area (lower neck to below the heart). The second component consists of a vest/jacket that is worn over a normal shirt. This component provides ballistic protection for areas where the first component's protection ends.

BRIEF DESCRIPTION OF THE SEVERAL VIEWS OF THE DRAWINGS

The first ballistic protection component, hereinafter referred to as the FBC, is attached around the wearer's neck and can have a similar ballistic component extending down the back.

FIG. 3, items 5 and 7, are securing straps which hold the FBC in place. These straps are adjustable to allow the wearer to adjust the FBC to personal fit. Item 6 is an example location for an adjuster.

Figure 1:
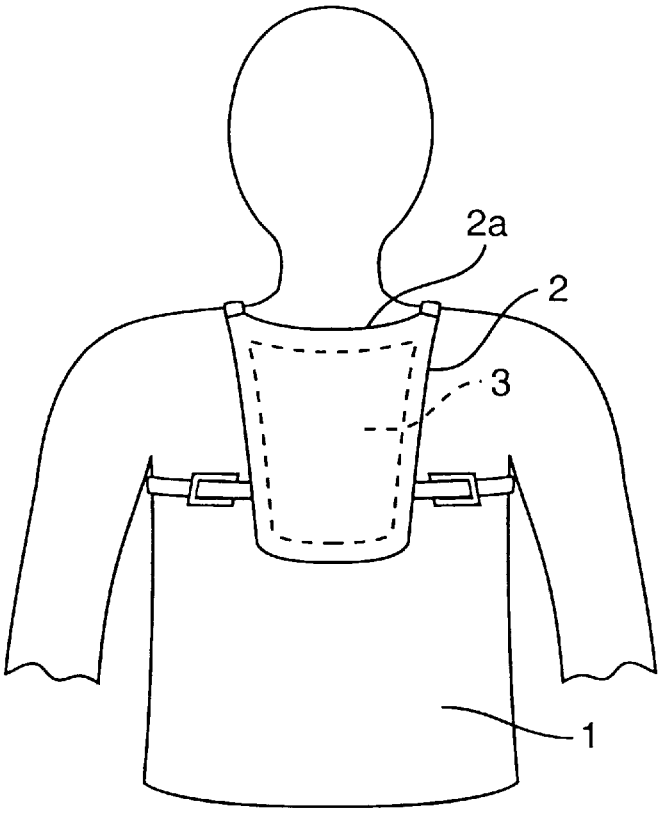
FIGS. 1 and 3 show the FBC being worn under a typical shirt. Item 2 is a soft ballistic armor with an optional ballistic plate (item 3) to provide increased ballistic protection.
Figure 2:
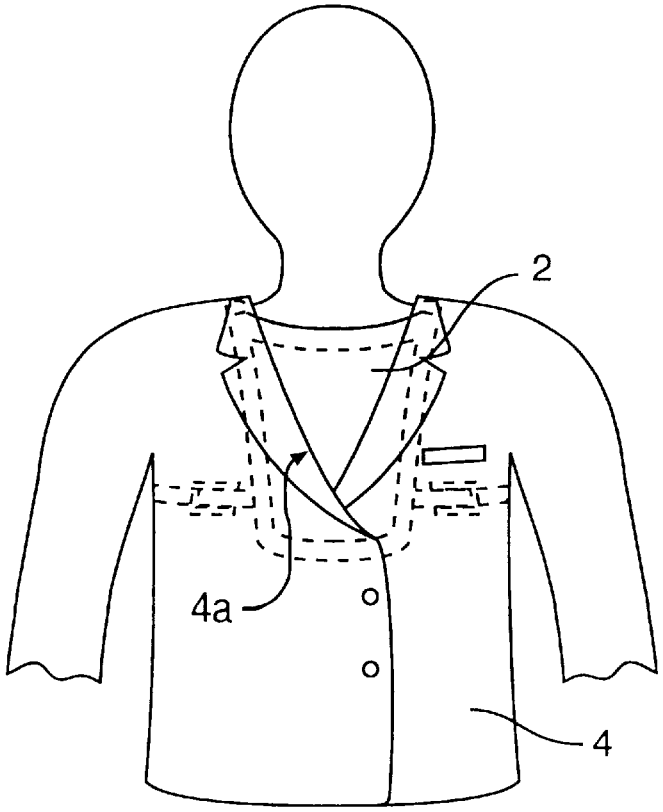
FIG. 2 shows the second component of the MIBAS system, the over component (Item 4), hereinafter referred to as second ballistic protection component (SBC), which is a ballistic jacket that combines with FBC to provide good frontal and rear upper torso protection with the advantages of ease of removal when not needed and providing inconspicuous protection.
Figure 3:
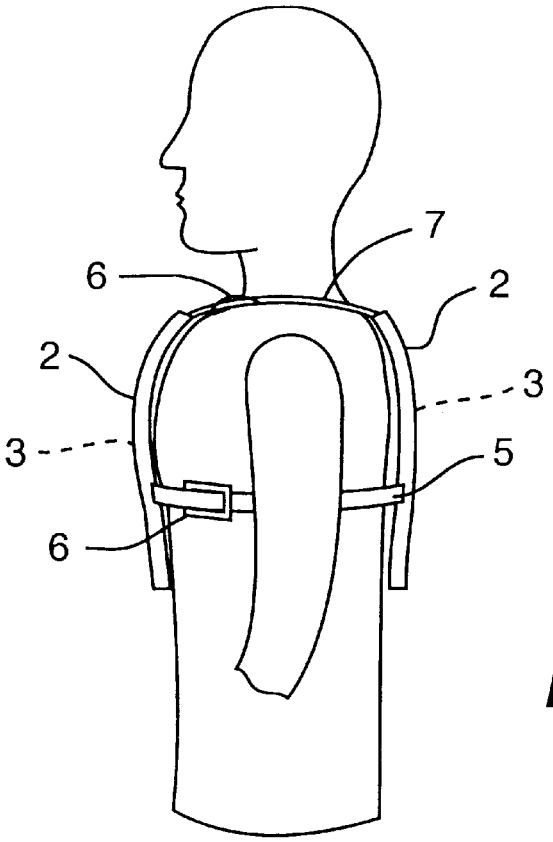
Figure 4:
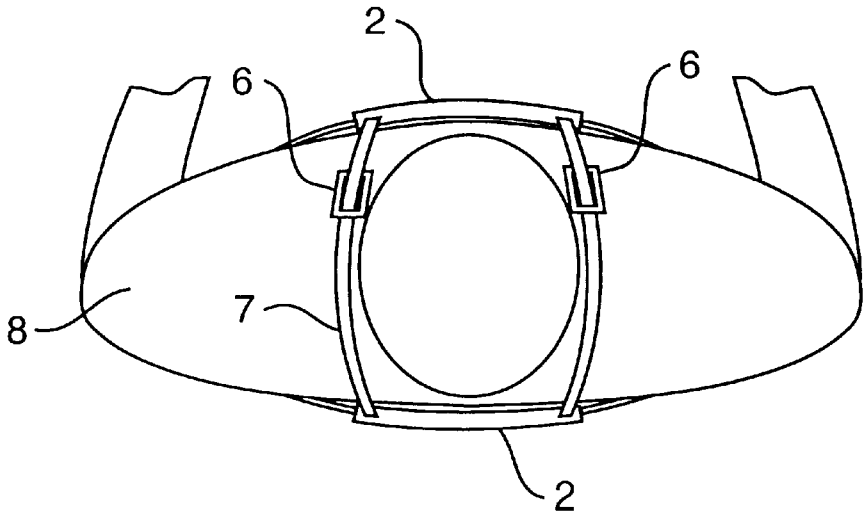
FIG. 4 is a top down view of an individual's torso (Item 8) showing a suspender-like approach (Item 7) to securing the FBC.

More specifically, as best shown in FIG. 1, a first ballistic material system component or first ballistic protection component (FBC) 2 is shown as having an upper edge 2*a* configured to cover a users lower neck. The component 2 further includes a depending portion configured to cover limited but vital areas of the front torso, e.g., the heart and lungs of the user. As more specifically shown in FIG. 2, a ballistic material system component worn over the shirt is shown as a jacket or coat shaped second ballistic protection component (SBC) adapted to be worn by the user separately from the FBC to provide ballistic protection to areas of the user's body that would otherwise not be covered by the FBC. Hence, as shown in FIG. 2, the jacket 4 includes a neck opening 4*a*, when buttoned provides frontal coverage of the user's body a that is not protected by the FBC.

DETAILED DECRIPTION OF THE INVENTION

The Multi-Piece Integrated Body Armor System consists of two components; ballistic material system component, generally worn under a shirt and shaped to provide ballistic protection to the lower neck, heart, and selected vital organs, (this component referred to as the FBC), and; a ballistic material system component generally worn over the shirt, such as an over-garment, that complements the first component by providing integrated ballistic protection, (this component referred to as the SBC). The FBC is comfortable and can be worn all day with minimum discomfort. The SBC is put on when the user is in an exposed environment and taken off when the user returns to a safe environment such as his office.

The FBC system can consist of a ballistic fabric with or without a trauma plate or a pocket and hard plate configuration for greater threats. Varying levels of protection can be designed whereby the under garment component may have a higher or lower level of protection that the outer garment component.

The SBC armor system can be concealed in a jacket or coat or externally worn similar to conventional vests or body armor. Many body armor systems open in the front and in hot environments, soldiers open the front to allow for air circulation and heat dissipation. A FBC worn by a user can reduce the ballistic threat exposure of an open vest and still allow ventilation to the current vest.

The SBC can be easily attached and detached to the jacket or coat through conventional attachment systems such as hook-and-loop, snaps, or button type fasteners. Simple attachments can be sewn or glued into an outer garment to allow the SBC to be easily attached or removed. This would allow the user to wear many different jackets or outer garments with one SBC.

The FBC and SBC will provide increased ballistic protection by them selves in emergency situations whereby the under or over-garments can be worn separately. The FBC is designed to cover the vital organs from a highly probable fatal shot while the SBC provides protection from less fatal shot lines.

What I claim as my invention is:

1. A multi-piece integrated body armor system comprising:

a first ballistic protection component configured to cover a users lower neck, and vital areas of the front torso;

a second ballistic protection component adapted to be worn by the user in combination with the first component to provide additional ballistic protection to areas not covered by the first component.

2. The multi-piece body armor system of claim 1 wherein the said FBC is configured as a dickey having a front portion and a back portion and straps joining said front portion and said back portion and configured to be supported on the shoulder of the user for hanging said front portion and said back portion, respectively, to cover the lower neck and front of the user and the back of the user.

3. The multi-piece body armor system of claim 1 wherein said neck opening is formed as a V-shaped neck opening.

4. The multi-piece body armor system of claim 1 wherein said first component has a different ballistic resistance than the second component.

5. The multi-piece body armor system of claim 1 wherein said FBC includes a carrier having a pocket therein; and a hard plate supported within said pocket.

6. The multi-piece body armor system of claim 1 wherein said outer garment included a concealed pocket therein and the second component is support within said concealed pocket.

7. The multi-piece body armor system of claim 1 wherein the second component includes a concealed attachment therein and the second component being detachably connected to said concealed attachment.

8. A body armor system comprising more than one separately worn parts comprising:

a first ballistic material means for wearing as a separate component under a shirt of a user;

a second ballistic material means for wearing as a separate component over a shirt of a user and in overlying relationship with the first means;

the first means including a front part for covering areas of the lower throat and heart of a user.

9. The multi-piece body armor system of claim 8 wherein the first means and the second means have different ballistic protection properties.

10. The multi-piece body armor system of claim 8 wherein the first means includes a carrier supported on the user and a hard plate carried by said carrier.

11. The body armor system of claim 8 wherein the first means is configured as a dickey having a front portion and a back portion and straps joining said front portion and said back portion and configured to be supported on a the shoulders of the users for hanging said front portion and said back portion, respectively, to cover the neck and front of the user and the back of the user.

12. The body armor system of claim 8 wherein the second means is an outer garment.

13. The body armor system of claim 12 wherein said outer garment includes a neck opening formed as a V-shaped neck opening and a front that can be opened while on the user.

14. The body armor system of claim 12 wherein the first means is configured to underlie the second means and to protect the lower neck and heart of the user apart from the second means.

15. The body armor system of claim 12 wherein the first means is configured to underlie the V-shaped neck opening and to protect the neck and heart of the user from ballistic passage through said V-shaped neck opening.

* * * * *